US006069354A

United States Patent [19]

Alfano et al.

[11] Patent Number: 6,069,354

[45] Date of Patent: May 30, 2000

[54] PHOTONIC PAPER PRODUCT DISPENSER

[76] Inventors: Robert R. Alfano, 3777 Independence Ave., Bronx, N.Y. 10463; Yury Budansky, 736 Ramapo Valley Rd., Oakland, N.J. 07463; Jing Cheng Luo, 1738 Stephen St. Apt. 3, Ridgewood, N.Y. 11385

[21] Appl. No.: 09/071,004

[22] Filed: May 1, 1998

Related U.S. Application Data

[63] Continuation-in-part of application No. 08/565,411, Nov. 30, 1995, abandoned.

[51] Int. Cl.[7] ..... G01V 8/12; B65H 26/00

[52] U.S. Cl. ..... 250/221; 312/34.8; 242/563

[58] Field of Search ..... 250/221; 312/34.8, 312/34.9, 34.11, 34.12; 242/563, 564.1, 564.2; 225/10, 11

[56] References Cited

U.S. PATENT DOCUMENTS

| | | | |
|---|---|---|---|
| 3,301,617 | 1/1967 | Goodwin et al. | 242/564.4 |
| 4,666,099 | 5/1987 | Hoffman et al. | 250/221 |
| 4,721,265 | 1/1988 | Hawkins | 250/221 |
| 4,796,825 | 1/1989 | Hawkins | 250/221 |
| 5,142,134 | 8/1992 | Kunkel | 250/221 |

*Primary Examiner*—Que T. Le
*Assistant Examiner*—Kevin Pyo
*Attorney, Agent, or Firm*—Kriegsman & Kriegsman

[57] ABSTRACT

A photonic paper product dispenser is provided for dispensing a portion of a roll of a paper product. The photonic paper product dispenser comprises a housing which holds the roll of the paper product. The dispenser further comprises a light source for emitting an infrared light signal and a photodetector affixed to the housing which detects infrared light from the source reflected by the user and converts the light to electrical signals. The dispenser further includes a signal processing circuit in electrical connection with the photodetector. The signal processing circuit receives and processes signals sent by the photodetector. The dispenser further includes a motor in electrical connection with said signal processing circuit. The dispenser further includes a pair of gears mechanically connected to the motor which rotate upon activation of the motor. The gears are mechanically connected to one of a pair of rollers, the roller rotating upon rotation of the gears. The pair of rollers are mounted in the housing so that they are frictionally engaged with the roll of the paper product. The roll of the paper product is fed tautly between the pair of rollers. As the roller connected to the gears rotates, the roll of the paper product will rotate causing a sheet of the paper product to advance out from the dispenser which can then be removed from the roll by the user without having to touch any part of the dispenser.

6 Claims, 13 Drawing Sheets

BLOCK DIAGRAM OF LIGHT PAPER DISPENSER 61

B: Voice Control

C: Remote Control

D: Infrared Emitter and Detector Control

BLOCK DIAGRAM OF LIGHT PAPER DISPENSER 61

TABLE 1 SHEET 1

PARTS LIST for PAPER DISPENSER

| *Element* | *Name* | *Description* | *Quantity* |
|---|---|---|---|
| SW2: | switch | AUTO. OPERATION SWITCH | (1) |
| SW3: | switch | OWER ON/OFF SWITCH | (1) |
| SW1: | switch | manual operation switch | (1) |
| IC3: | Integrated Circuit | to reject noise signals | (1) |
| IC1: | Integrated Circuit | IC1B: to amplify detected signal | (1) |
| | | IC1C: to filter out lower frequency noises | |
| | | IC1D: to clip the DC level of input signal | |
| IC2: | Integrated Circuit | IC2B: to consist the timer to fit the length of the paper that come out from the dispenser | (1) |
| | | IC2D: to consist the Schmidt circuit to convert the analog input signal to digital signal | |
| | | IC2A and IC2C are not used | |
| IC4: | Integrated Circuit | 9 volt regulator | (1) |
| IC5: | Integrated Circuit | 5 volt regulator | (1) |
| Q1,Q3: | transistor | to amplify signal and reduce the output impedance | (2) |
| Q2: | sensor | to detect the reflected infrared light signal from a user' s hand | |
| Q4: | transistor | to drive the motor to move the paper | (1) |
| C1: | capacitor | the timing capacitor of the pulse generator IC3 | |
| C5: | capacitor | by-pass capacitor | (1) |
| C6,C8: | capacitor | by-pass capacitor | (2) |

Fig. 9

TABLE 1 SHEET 2

| *Element* | *Name* | *Description* | *Quantity* |
|---|---|---|---|
| C2,C3: | capacitor | the filter capacitor of the high pass filter IC1C | (2) |
| C4: | capacitor | coupling capacitor | (1) |
| C7,C10: | capacitor | coupling capacitor | (2) |
| C8: | capacitor | the timing capacitor of the Monostable timing circuitr IC2B | (1) |
| QT | | to emit infrared light source | (1) |
| D2,D3,D4,D5,D6,D7,D8 | diode | D2,D3,D4,D5: to set required DC offset voltage of the circuit | (9) |
| C9: | capacitor | by-pass capacitor | (1) |
| C12: | capacitor | power source capacitor | (1) |
| C13,C14: | capacitor | by-pass capacitor | (2) |
| D1: | infrared LED | | |
| D6,D7,D8: | | to control the direction of the signal | |
| D9,D10: | Diodes: | D9: to limit the revertive impulse<br>D10: the power Rectifier Diodes | (5) |
| W1: | variable resistor | to adjust the system sensitivity and noise immunity | (1) |
| W2: | variable resistor | to adjust the paper throughput | (1) |
| R1,R3,R11,R22,R25: | resistor | basic elements of circuit | (5) |
| R6,R7,R14,R16,R19,R20,R21, R23: | resistor | basic elements of circuit | (8) |
| R5,R17,R18,R24,R26 | resistor | basic elements of circuit | (5) |
| R4: | resistor | basic elements of circuit | (1) |
| R2: | resistor | basic elements of circuit | (1) |

Fig. 10

TABLE 1 SHEET 3

| *Element* | *Name* | *Description* | *Quantity* |
|---|---|---|---|
| R9: | resistor | basic elements of circuit | (1) |
| R8: | resistor | basic elements of circuit | (1) |
| R10: | resistor | basic elements of circuit | (1) |
| R12,R15: | resistor | basic elements of circuit | (2) |
| R13: | resistor | basic elements of circuit | (1) |
| R27: | resistor | basic elements of circuit | (1) |
| MOTOR: | | to move the paper | (1) |
| CN1: | | the power cord | (1) |
| F1 | FUSE: | to protect the system overload | (1) |
| T1: | transformer | to get a 12V AC voltage power source | (1) |

Fig. 11

Index to Figure:

17. Dispenser body
35. Front plastic cover
49, 51. Dispensing rollers
45. Motor
D1. Emitter
Q2. Receiver
55. Manual button
53. On/Off switch
47. Gears
15. Paper towel

PHOTONIC PAPER PRODUCT DISPENSER

CROSS-REFERENCE TO RELATED APPLICATIONS

This application is a continuation-in part of pending U.S. patent application Ser. No. 08/565,411 filed on Nov. 30, 1995, now abandoned, which application is incorporated herein by reference.

BACKGROUND OF THE INVENTION

The present invention relates generally to paper product dispensers and more specifically to a photonic paper product dispenser.

Paper product dispensers used for the containment and the dispensing of paper products are well-known devices.

Paper products are commonly used to dry and clean one's hands, face, and other body parts. Such paper products are commonly housed in a paper product dispenser which can be readily found in the home of a person, the office of a doctor, operating rooms, public bathrooms, offices and other commercial settings.

Commonly after washing in a public restroom, one would desire to dry oneself with a paper product, such as a paper towel. Very often, the user is required to touch a control mechanism in order to dispense the paper product for use. Very often the control mechanism will be touched by one or more previous users, thereby increasing the potential risk for the user to be exposed to germ contamination. It is therefore desired to prevent the user from being inflicted from germ contamination by creating a paper product dispenser which does not require the user to have to touch a control mechanism.

Similar attempts have been made in the art to create sinks and toilets which do not require user contact to effectively operate the devices. This has lead to the use of photonics to turn sinks on and off and to flush toilets through motion detection, rather than physical contact. These photonic devices enable the user to effectively clean himself without having to touch a control mechanism commonly contacted by prior users. The elimination of physical contact serves to prevent transmission of dangerous bacteria, germs, and viruses.

SUMMARY OF THE INVENTION

It is an object of the present invention to provide a new and improved paper product dispenser.

It is another object of the present invention to provide a paper product dispenser which can dispense paper products without requiring the user to touch a control mechanism.

It is yet another object of the present invention to provide a paper product dispenser which can be mass produced, has a minimal number of parts, and can be very easily used.

Accordingly, there is provided a photonic paper product dispenser for dispensing a portion of a roll of a paper product, comprising a housing for holding the roll of the paper product therewithin; a photodetector affixed to said housing for detecting a change in the light level in front of said photodetector and converting the change in the light level to an electrical signal; a control switching circuit in electrical connection with said photodetector for receiving the electrical signal sent by said photodetector upon the detection of a change in the light level and analyzing the signal to determine whether the signal meets the minimum limitation of motion, the signal being passed only when the signal meets the minimum limitation of motion; a motor in electrical connection with said control switching circuit, said motor being activated upon said control switching circuit passing the signal; one or more gears mechanically connected to said motor, said one or more gears rotating upon activation of said motor; and a pair of rollers mounted in said housing, one of said rollers being mechanically connected to said gears causing said roller to rotate upon rotation of said gears, the pair of rollers being frictionally engaged with the roll of the paper product thereby causing rotation of the roll of the paper product upon rotation of said roller, rotation of the roll of the paper product advancing a sheet of the paper product out from the housing which can then be removed from the roll.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration of various embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts:

FIGS. 9, 10 and 11 are a parts list for the components of the dispenser of FIG. 7;

DETAILED DESCRIPTION OF A PREFERRED EMBODIMENT

Figure 1:
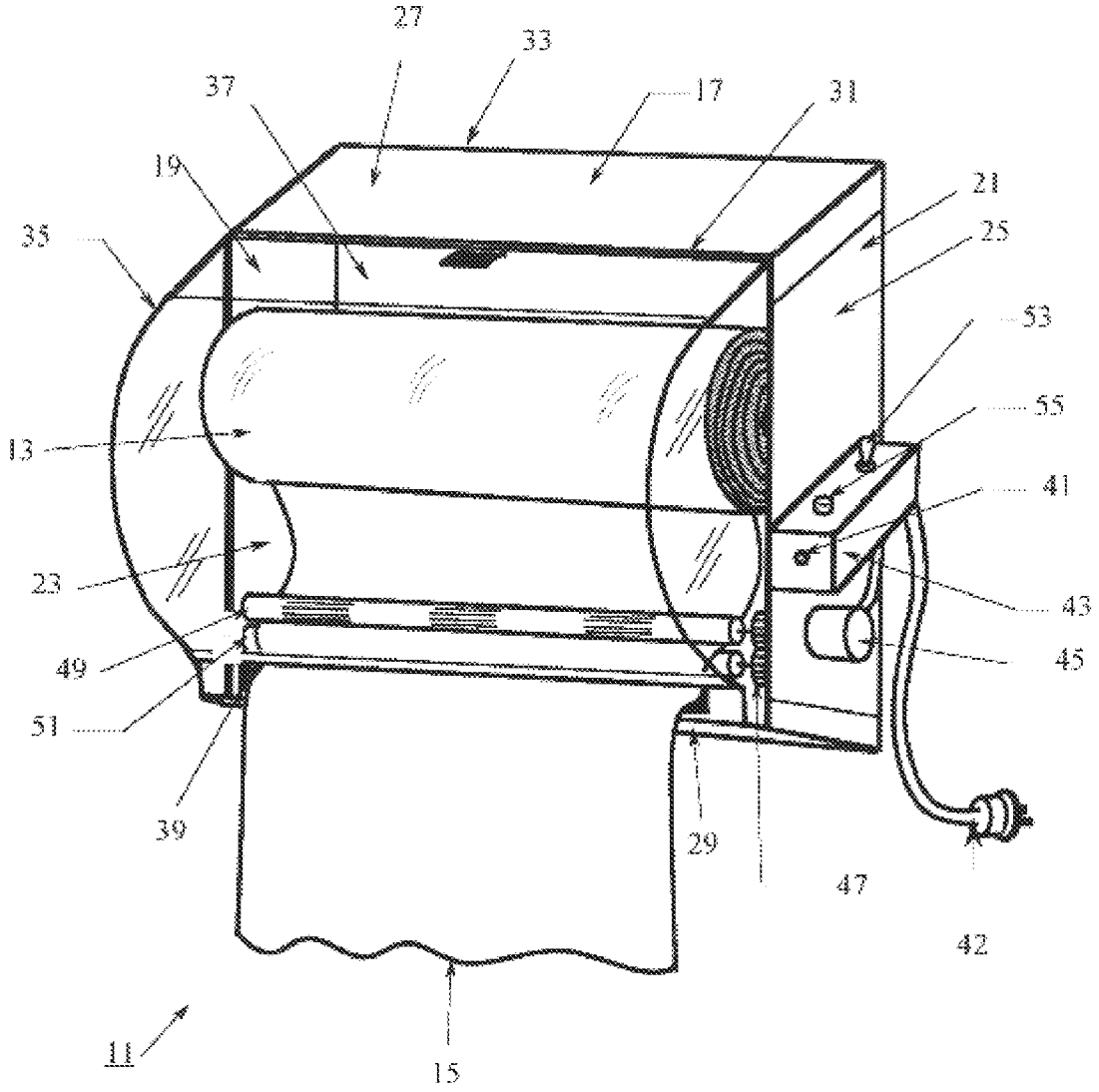
FIG. 1 is a front perspective view of a photonic paper product dispenser constructed according to the teachings of the present invention, the photonic paper product dispenser being shown with a roll of a paper product.

Referring now to FIG. 1, there is shown a front perspective view of a photonic paper product dispenser constructed according to the teachings of the present invention, the photonic paper product dispenser being represented generally by reference numeral 11. Photonic paper product dispenser 11 may be used to dispense a portion of a roll of a paper product without requiring the user to have to touch a control mechanism which renders dispenser 11 applicable for hospital, restaurant, office, and public bathroom use. So that the use of photonic paper product dispenser 11 may be clearly understood, FIG. 1 displays photonic paper dispenser 11 as well as a roll of a paper product 13 having a free end 15.

Photonic paper product dispenser 11 includes a housing 17. Housing 17 is a generally rectangular box having an inner surface 19, an outer surface 21, a left side 23, a right side 25, a top 27, a bottom 29, an open front 31, and a closed rear 33. Removably mounted to open front 31 is curved member 35. Curved member 35 is a curved translucent piece of material such as plastic which is mounted to open front 31 of housing 17 to define an enlarged opening 37 within housing 17 and curved member 35. Curved member 35 is mounted to housing 17 so that an elongated slot 39 is formed at the junction of curved member 35 and bottom 29 of housing 17. Free end 15 of roll 13 is fed through elongated slot 39 to enable the user to remove a portion of roll of paper product 13 from dispenser 11 without having to touch any part of dispenser 11.

Roll of paper product 13 is mounted in enlarged opening 37, one end of roll 13 being mounted to inner surface 19 of left side 23 and the other end being mounted to inner surface 19 of right side 27. Due to the translucent properties of curved member 35, one is able to see inside dispenser 11 and determine whether roll 13 needs to be replaced. If roll 13 needs to be replaced, curved member 35 can be removed from housing 17, a new roll can be mounted in housing 17, and then curved member 35 can be remounted to housing 17.

Figure 6:
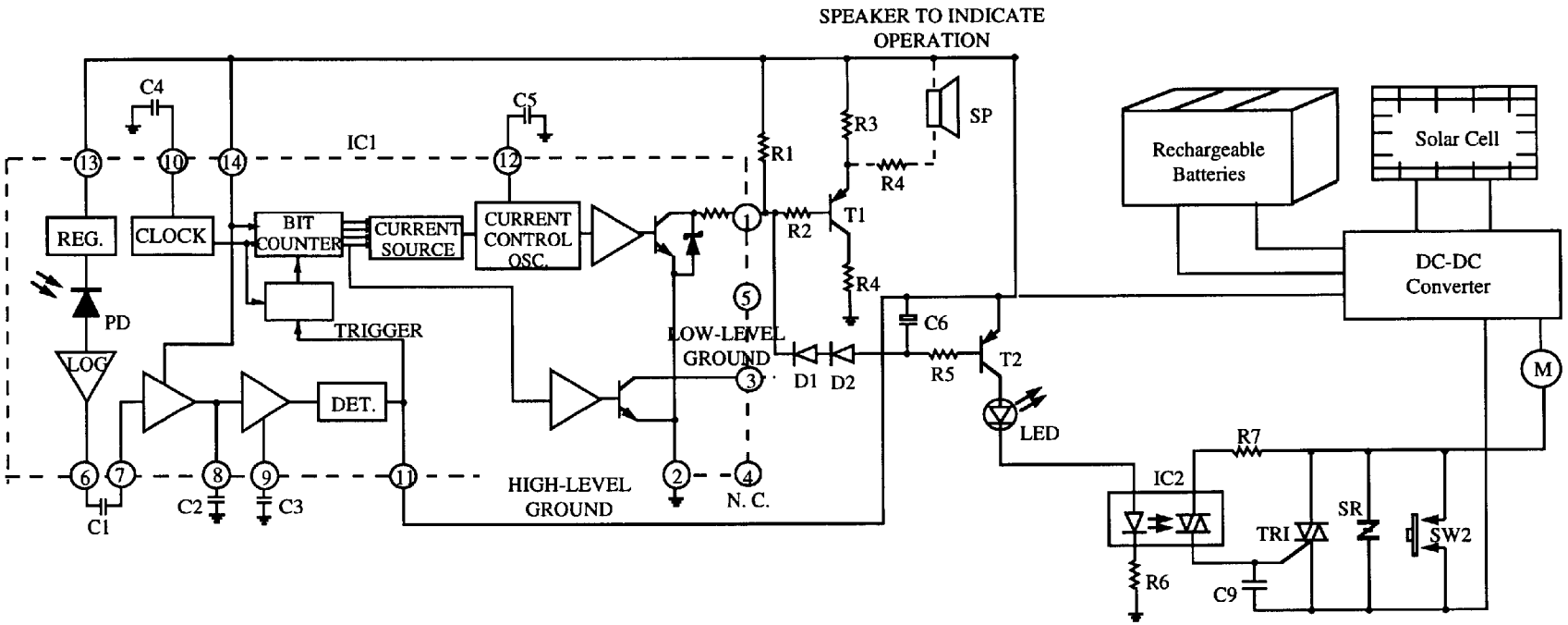
FIG. 6 is a block diagram of another embodiment of the control switching circuit of FIG. 1, the control switching circuit using a solar power unit to supply power to the control switching circuit.

Photonic paper product dispenser 11 further includes a photodetector 41 mounted on outer surface 21 of right side 25, photodetector 41 facing in the direction from closed rear 33 to open front 31. Photodetector 41 detects changes in the light level directly in front thereof. For example, if a user were to waive his hand directly in front of photodetector 41, photodetector 41 would detect the motion and convert it to an electrical signal. Photodetector 41 includes a power cord 42 through which power is supplied. It should be noted that power could be supplied to dispenser 11 by an alternative source instead of power cord 42. For example, dispenser 11 could be powered by room light using an array of solar silicon cells, one or more rechargeable batteries which serve as a backup, and a DC-DC converter as shown in FIG. 6. In this embodiment, dispenser 11 would be portable, enabling dispenser 11 to be moved to any desired location.

Figure 2:
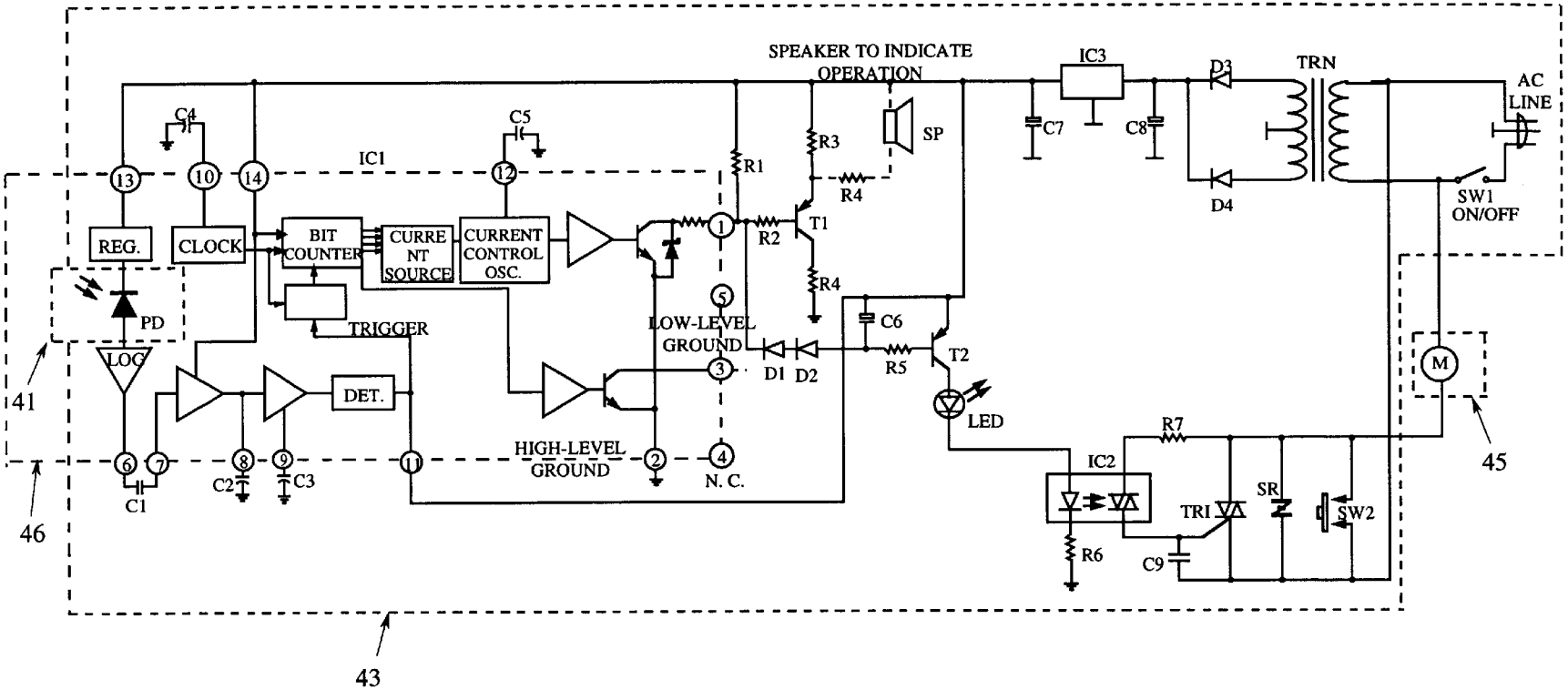
FIG. 2 is a schematic representation of the control switching circuit of FIG. 1 shown in electrical connection with the photodetector and the motor.
Figure 3:
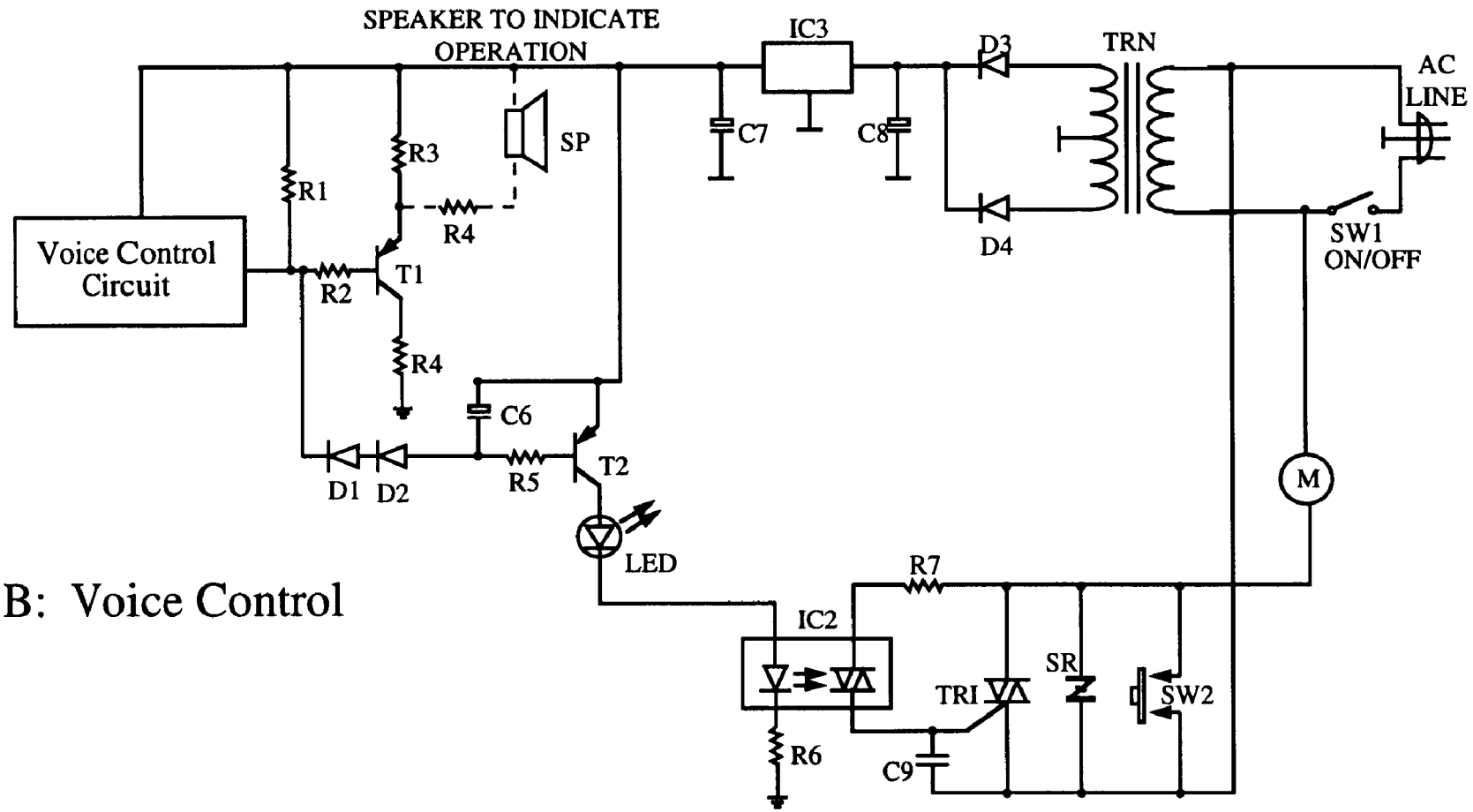
FIG. 3 is a block diagram of another embodiment of the control switching circuit of FIG. 1, the control switching circuit using voice signals to activate the motor.
Figure 4:
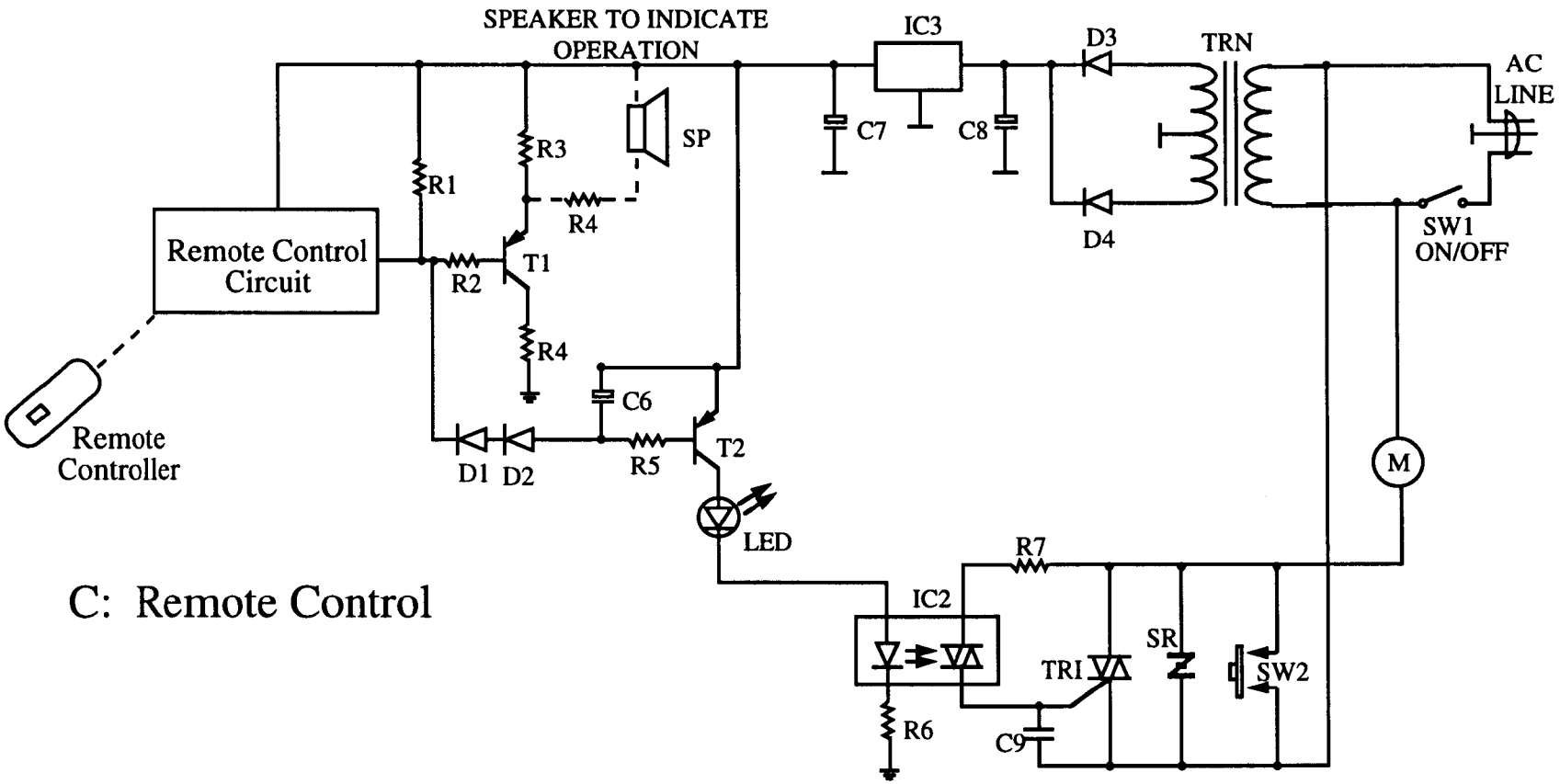
FIG. 4 is a block diagram of another embodiment of the control switching circuit of FIG. 1, the control switching circuit using a remote control to activate the motor.
Figure 5:
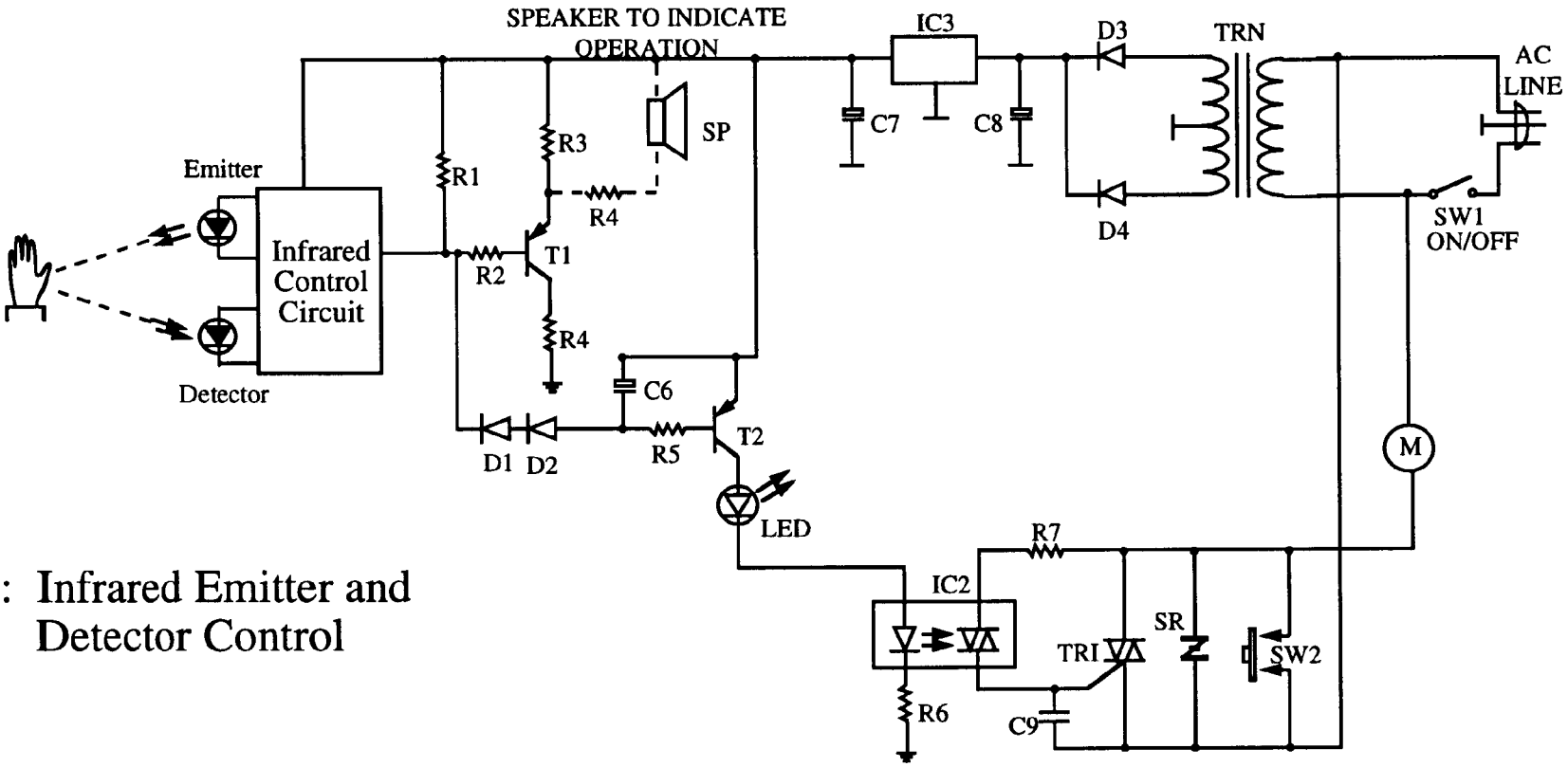
FIG. 5 is a block diagram of another embodiment of the control switching circuit of FIG. 1, the control switching circuit using a light emitting and reflecting unit to activate the motor.

Photonic paper product dispenser 11 further includes a control switching circuit 43 electrically connected to photodetector 41 (see FIG. 2). When photodetector 41 converts detected motion to an electrical signal, the signal passes to control switching circuit 43 which then analyzes the signal to determine the strength of the detected motion. If circuit 43 registers the detected motion as meeting the programmed minimum limitation of motion, a positive signal is then passed. Control switching circuit 43 includes a photo-motion control circuit 46 which detects changes in motion detected by photodetector 41 to further activate motor 45. It should be noted that photo-motion control circuit 46 could be replaced by alternative control circuits which could activate motor 45 by different means. For example, motor 45 could be activated by voice control as shown in the block diagram in FIG. 3. Similarly, motor 45 could be activated by remote control as shown in the block diagram in FIG. 4. Additionally, motor 45 could be activated by an infrared emitter and detector control as shown in the block diagram in FIG. 5.

Photonic paper product dispenser 11 further includes a motor 45 which is electrically connected to circuit 43. When circuit 43 passes on a positive signal, the signal is passed to motor 45 which in turn becomes activated. Motor 45 is mounted through right side 25 of housing 17, and a positive signal from circuit 43 turns the portion of the motor 45 on inner surface 19 of housing 17.

Photonic paper product dispenser 11 further comprises a pair of gears 47 mechanically connected to the portion of motor 45 on inner surface 19 of housing 17. Rotation of motor 45 in turns causes the rotation of pair of gears 47.

Photonic paper product dispenser 11 further comprises an upper roller 49 and a lower roller 51. One end of rollers 49 and 51 are mounted on inner surface 19 of left side 23 and the other end of rollers 49 and 51 are mounted on inner surface 19 of right side 27, with upper roller 49 being positioned directly above lower roller 51. The distance between rollers 49 and 51 is such that free end 15 of roll 13 can be fed between rollers 49 and 51 so that free end 15 is frictionally engaged tautly between rollers 49 and 51. Gears 47 are connected to upper roller 49 so that as gears 47 rotate, likewise upper roller 49 will rotate. Due to the frictional engagement of free end 15 with rollers 49 and 51, as roller 49 rotates, roll of paper product 13 will rotate, advancing free end 15 out through elongated slot 39 at a length, at a speed, and at a specified sensitivity of detectable motion which can be adjustibly programmed into circuit 43. The user can then remove the paper product extending out from elongated slot 39. It should be noted that the number of sheets or the length of paper which advance out through elongated slot 39 could be adjusted through the implementation of a control knob or switch which would be connected to circuit 43.

It should be noted that gears 47 could be connected to both upper roller 49 and lower roller 51 to similarly advance roll of paper product 13.

Photonic paper product dispenser 11 further comprises an on/off switch 53 for activating and deactivating photodetector 41, and a manual backup button 55, which when depressed sends an electrical signal to circuit 43 which activates motor 45, turns gears 47 and roller 49, and thereby advances roll of paper product 13 out through elongated slot 39.

The following is an index to circuit 43:

It should be noted that the activation of paper dispenser 11 need not be limited to the use of photodetector 41 which acts upon light motion. Paper dispenser 11 could alternatively be designed to become activated by a remote control unit based on radio waves, sound or word command signals, or LED reflection for use in dark rooms.

Figure 7:
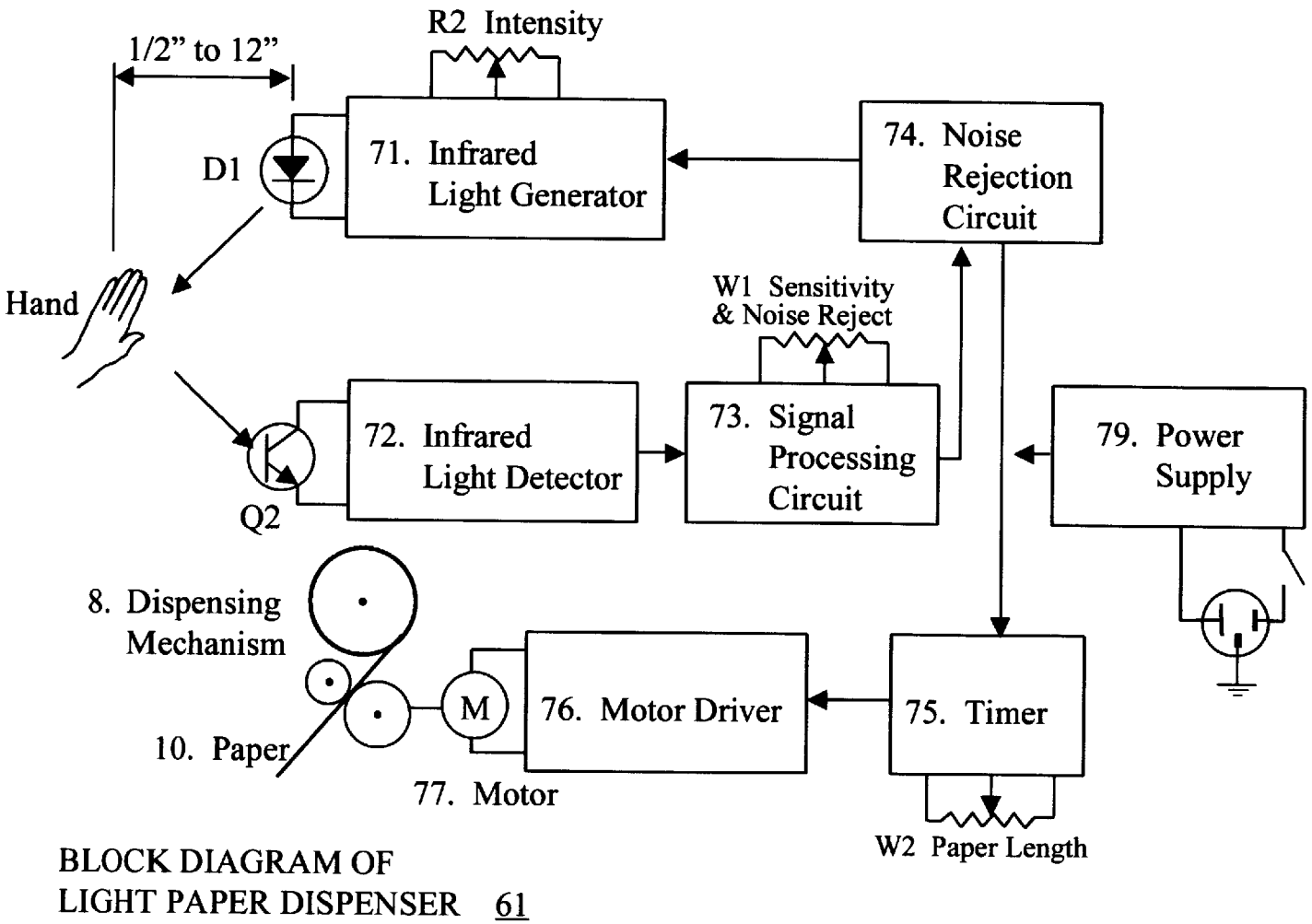
FIG. 7 is a block diagram of another embodiment of a photonic paper product dispenser constructed according to the teachings of the present invention.

Another embodiment of a paper product dispenser constructed according to the teachings of the present invention is shown in FIG. 7 and is identified by reference numeral 61.

Figure 13:
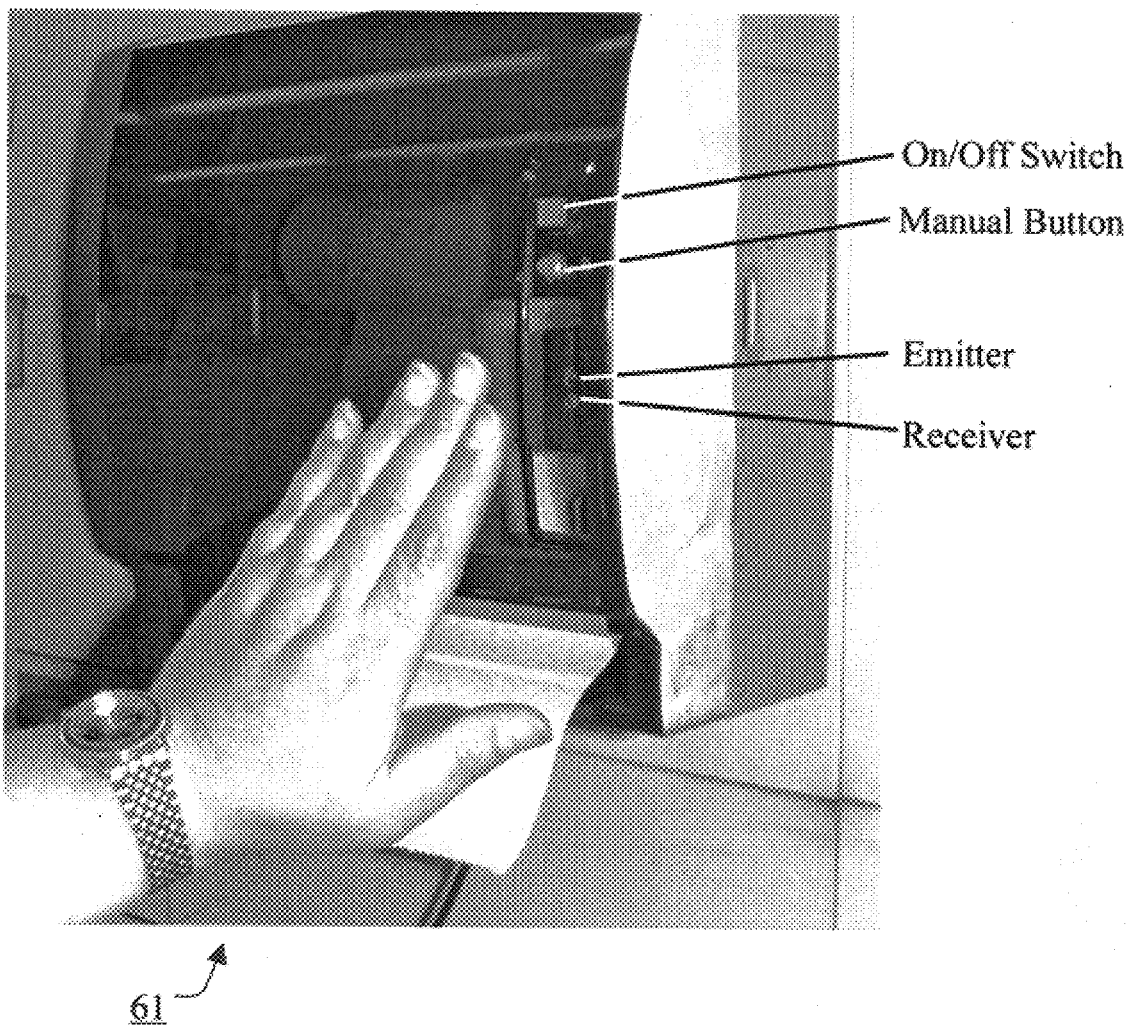
FIG. 13 is a view showing the dispenser of FIG. 7 in operation.

As can be seen in FIG. 13, the light source and the detector are mounted facing the user. The detector detects the diffusive reflectance light signal from a hand of the user. The distance range of use is from ½" to 12" from the unit.

Also, dispenser 61 has special noise immunity electronic circuits to exclude possible triggers caused by outside noises, such as 60 Hz power line signal, room light and other pulse signals. Thus, it is more reliable to a commercial and bathroom setting.

Also, dispenser 61 has a special signal processing circuit for the collected non-specular reflected light from tissue to achieve wide signal dynamic range of light intensity. Dispenser 61 can be used in a complete dark or a very bright room.

Also, dispenser 61 has a sensitivity user controller component for activation. The active distance between a hand of a user and the source-detector can be adjusted to meet different requirements for different application environments.

Description of Working Principle:

In dispenser 61, a diffusive reflectance-type infrared detection system switches the apparatus on automatically to control the unit to dispense paper to a predetermined length of paper.

FIG. 7 is a block diagram of main components of dispenser 61. In the auto mode, the infrared light generator 71 generates square wave, about 1.2 kHz, to drive an infrared LED D1 to transmit modulated infrared light as an infrared light source for reflection detection.

Changing the intensity level by setting R2 in the generator 71 can change the infrared light power emitted from D1. As a user places his hand in front of D1 within a predetermined action distance L between user's hand and D1, part of modulated infrared light is reflected back to infrared light detecting Photo-transistor Q2 in the infrared detector 72. Photo-transistor Q2 detects the modulated infrared light signal and converts the modulated infrared light signal into electric signal in the infrared detector 72. The electric signal then passes to the signal processing circuit 73 for noise reduction and signal amplification and then output a five volts square wave with the same frequency as received at the infrared detector Q2. The square wave is then fed to the interference suppression circuit 74 for further analysis. Changing the sensitivity & noise rejection setting resistor W1 in the signal processing circuit 73 can change the circuit sensitivity responding to the signals received in the infrared detector 72. The interference suppression circuit 74 excludes all other received signals generated by other light sources, electromagnetic sources and city utility AC power line, and only recognizes the signal with the same frequency and phase in the infrared light generator 71. Once the interference suppression circuit 74 recognizes a signal with the same frequency as in the infrared light generator 71 is being received, it will output a low level voltage signal to trigger the timing circuit 75. The interference suppression circuit 74 guarantees this apparatus' noise immunity in a noisy environment and thus make it practical for public use. After the timing circuit 75 is triggered the timing circuit 75 generates a predetermined length of time signal to enable the motor drive 76 and the motor drive 76 actives the motor 77, the motor 77 then drives the mechanism 78 to dispense paper 79, the predetermined length of time signal determines the length of the paper 10 being dispensed to user.

Figure 8:
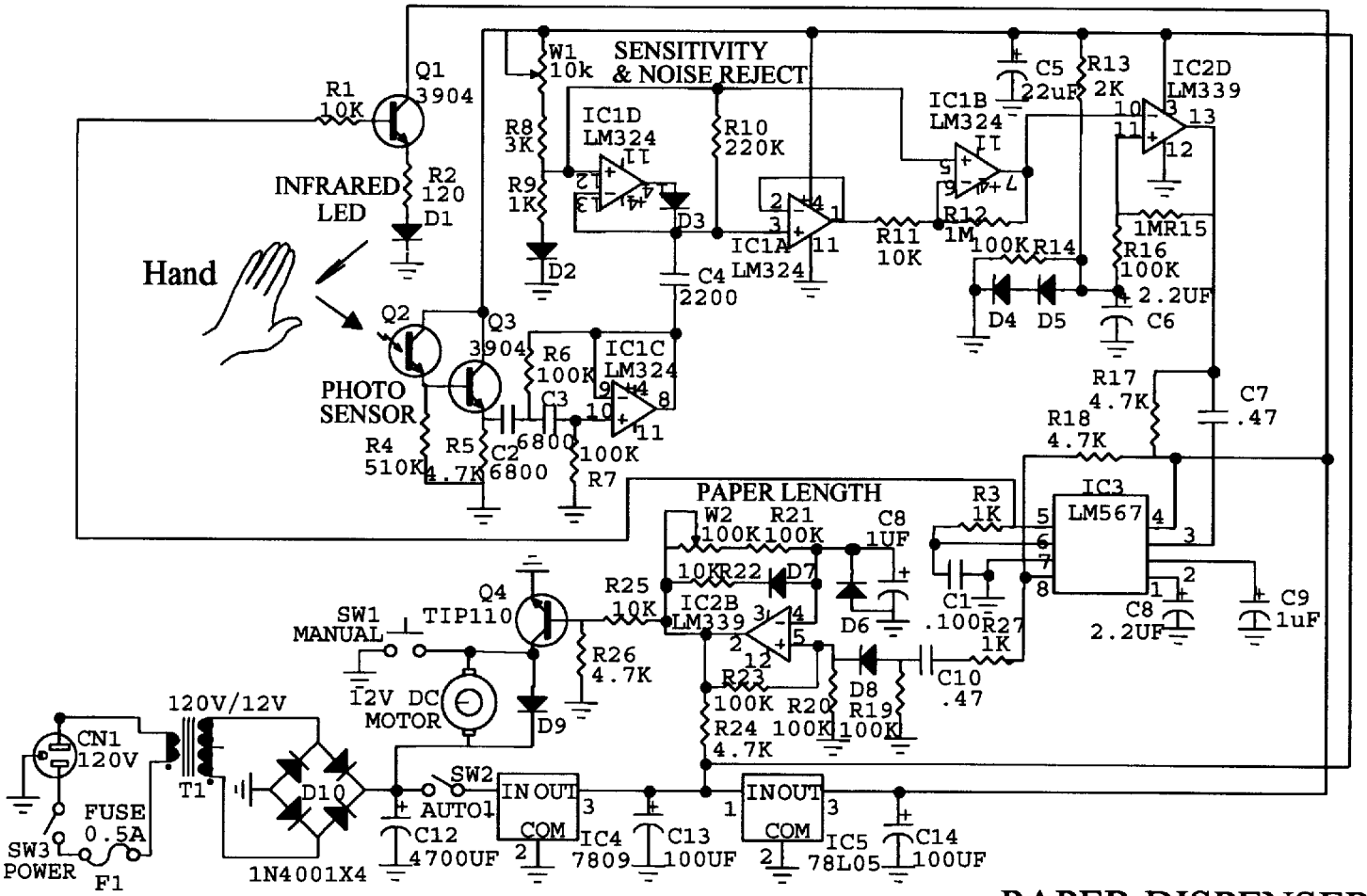
FIG. 8 is a schematic representation of the control switching circuit of FIG. 7.

Changing the intensity setting R2 in the infrared light generator 71 and the sensitivity & noise rejection W1 in the signal processing circuit 73 can change the predetermined action distance L as result. To avoid other moving objects or human accidentally trigger the dispenser, the best L should be within ½ inch to one foot. A schematic showing the operation of the unit is shown in FIG. 8.

This unit has been built, operated, and tested (see FIG. 13).

Description of Schematic Circuit Diagram

FIG. 2 shows a schematic circuit diagram to operate the diffusive reflectance type infrared detection switch apparatus in the invention.

(71) Infrared Light Generator:

Light is produced by Light Emitting Diode (LED) D1 at wavelength about 880 nm at modulated signal. An oscillator in IC3 generates a square wave with frequency about 1.2 kHz which is determined by R3 and C1. The square wave passes through a emitter follower, consisted by R1, Q1 and R2, to drive infrared emitter D1, and thus D1 transmits a modulate infrared light with frequency about 1.2 kHz.

(72) Infrared Light Detector:

A silicon photo-sensor/detector, Q2, measures the light at the wavelength from the LED (D1) source producing a signal. The infrared light detecting circuit consists of Q2, Q3, R4 and R5. Infrared receiving photo-transistor Q2 and infrared emitter D1 are mounted on the same surface of the circuit board and both face out to user. When the transmitted infrared light from D1 encounters a object, such as a user's hand, part of infrared light is reflected back to Q2. Q2 transfers infrared light signal into electric signal, and the electric signal is then amplified by current amplifier Q3 and passes onto signal processing circuit

(73) Signal Processing Circuit:

The signal processing circuit consists of a signal amplifier and a wave form shaping circuit. Its principle is to suppress any interference signal received from Q2, to amplify and transform the intended useful signal into a square wave, and thus improve its noise immunity.

IC1C, C2, C3, C4, R6 and R7 form a second order high pass filter, it rejects all interfering signals with frequency under 300 Hz which include the 60 Hz noise generated by city utility power line, and allows signal with frequency above 300 Hz to pass through to a DC (direct current) voltage clamping circuit.

IC1D, D3, W1, R8, R9 and D2 form the DC voltage clamping circuit, it clamps all different level input signal on the same DC voltage base level that is determined by W1, R8, R9 and D2 for best signal amplification and shaping in the next stage of signal processing. This guarantees a great dynamic range in signal processing. After this clamping circuit the signal is passed on a voltage follower formed by IC1A for current amplification. IC1A also has a function of impedance matching between IC1D and IC1B which is the heart of a voltage amplifier next.

IC1B, R11 and R12 form the voltage amplifier, which amplifies small signals from IC1A to a sufficient level to trigger a Schmitt trigger circuit connected in next stage. The voltage gain of this amplifier is determined by the ratio of R12 and R11; R12/R11.

The Schmitt trigger circuit consists of R13, R14, R15, R16, D4, D5, C6 and IC2D. Here is how the Schmitt trigger circuit works; signals from pin 7 of IC1B, which is clamped by the network of W1, R8, R9 and D2, applied at pin 10 of IC2D is compared with the voltage at pin 11 of IC2D, that is determined by a resistor and diode network of R13, R14, D4 and D5, the compared result will trigger, or not trigger, IC2D. Changing the setting of W1 will change the triggering voltage level of IC2D, thus change the sensitivity of the entire circuit, suppress interference of ripple noises in the circuit, thus optimize the working condition of the apparatus. When IC2D is triggered a five volt square pulse will appear at the output of IC2D pin 13 and passed to a noise rejection circuit next. When IC2D is not triggered, pin 13 of IC2D remain low level volt.

(74) Noise Rejection Circuit:

IC3, C8 and C9 form a noise rejection circuit. This circuit rejects noise in form of frequency and phase. It only recognize the signal with the same frequency and phase which is generated by itself and determined by R3 and C1 as described in (1), about 1.2 kHz. Noise that accidentally passes the previous noise reduction and suppression circuits will be finally rejected here by being examined its frequency and phase, and thus guarantees the apparatus free from interference of any kinds of noise. When it recognizes the predetermined signal as described in (1) and (2), pin 8 of IC3 will go low, and trigger a monostable timing circuit connected next.

(75) Monostable Timing Circuit:

The monostable timing circuit consists of IC2B, W2, R21, R22 D6, D7, C11, R20, R23, R24, D8, R19 and C10. When pin 8 of IC3 goes low, it causes the differential circuit C10 and R19 to trigger pin 5 of IC2B through D8 and the pin 2 of IC2B will go high and stay high for a predetermined period of time which is determined by W2, R21 and C11. And pin 2 of IC2B will go low again after that period of time. When pin 2 of IC2B is high, it active a motor through a motor driver to start dispensing paper. When pin 2 of IC2B is low, it stops the motor and the paper dispensing action. Changing W2 can change the duration of time that pin 2 of IC2B stay high and thus determines how long the paper will be dispensed. R22, D6 and D7 are used to shorten the recovering time of this monostable time circuit, thus shorten the waiting period of the second action of use.

(76) Motor Driver:

SW1, Q4, R25, and R26 form a motor drive to drive the paper dispensing mechanism. When pin 2 of IC2B is low, the base of Q4 is also forced to low, Q4 is cutoff (not conducted), no current goes through Q4's collector and emitter and the motor, the motor is stop (inactivated). When pin 2 of IC2B is high, the base of Q4 is forced to high, Q4 will be saturated (conducted); the collector of Q4 is pulled low, and thus pulls one end of the motor to ground, current starts to flow through the Q4 and the DC motor; motor starts (activated) and paper is being dispensed. SW1 is a normal open mechanical switch. When manually pressing SW1 current will go through the DC motor and SW1; motor start. When SW1 is not pressing, motor stops and leaves the control to Q4 described above, which is in auto mode.

(77) Power Supply:

The power supply consists of F1, T1, C12, C13, C14, SW2, IC4 and IC5. When SW3 is open, no power will be applied to the entire apparatus. When SW3 is close, the 120 volt AC is applied to the primary side of transformer T1 through F1. Ti couples and reduces the 120 volt AC to a twelve volt AC at the secondary side of T1. The twelve volt AC is then rectified by a bridge rectifier D10 and smoothed by C12, a about 14 volt DC voltage power is ready at the ends of SW2 and the motor for the use of the circuit. When SW2 is open, the apparatus can only be operated manually by pressing SW1. When SW2 is closed, the 14 volt DC voltage will be regulated into a nine volt DC voltage supply appearing at pin 3 of IC4 by a nine volt DC voltage regulator IC4. The nine volt DC supply is further regulated into a five volt DC voltage supply by a five volt DC voltage regulator IC5. C13 and C14 act as voltage pools of nine volt and five volt DC voltage power supplies. When SW2 is closed, the apparatus is in the auto mode. The nine volt and five volt DC voltage power supplies provide proper working voltages for the circuits (71) through (76) described above. The Purpose of using two different DC voltage power supplies, nine volt and five volt, is to isolate circuit (71) from the rest of circuit so that the noise generated in (71) will not pass onto the entire circuit through a single power supply line. Fuse F1 is for human safety and protection. When there is too much current drawn in the circuit, F1 will be blown and cut off the 120 volt AC from the apparatus, thus protects human and the apparatus.

Figure 12:
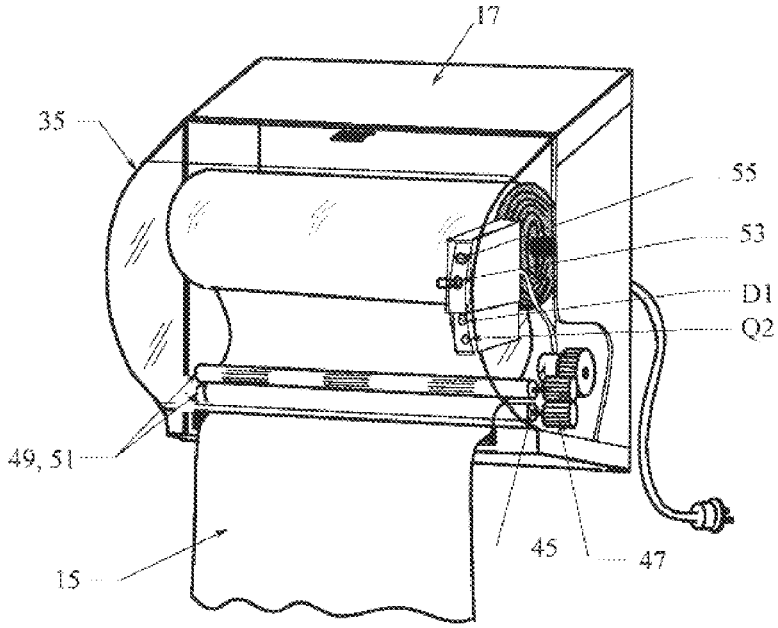
FIG. 12 is a front perspective view of the dispenser of FIG. 7.

A diagram of dispenser 61 is shown in FIG. 12. A view of dispenser 61 in operation is shown in FIG. 13 with a hand starting the unit to dispense sheet of paper.

The embodiments of the present invention described above are intended to be merely exemplary and those skilled in the art shall be able to make numerous variations and modifications to it without departing from the spirit of the present invention. All such variations and modifications are intended to be within the scope of the present invention as defined in the appended claims.

TABLE I

PARTS LIST for PAPER DISPENSER

| Element | Name | Model | Description | Quantity |
|---|---|---|---|---|
| SW2: | switch | SPST | AUTO. OPERATION SWITCH | (1) |
| SW3: | switch | SPST | POWER ON/OFF SWITCH | (1) |
| SW1: | switch | push on | manual operation switch | (1) |
| IC3: | Integrated Circuit | LM567 | to reject noise signals | (1) |
| IC1: | Integrated Circuit | LM324 | LM324 consists of 4 Operational amplifiers:<br>IC1B: to amplify detected signal<br>IC1C: to filter out lower frequency noises<br>IC1D: to clip the DC level of input signal | (1) |
| IC2: | Integrated Circuit | LM339 | LM339 consists of 4 Comparators:<br>IC2B: to consist the timer to fit the length of the paper that come out from the dispenser<br>IC2D: to consist the Schmidt circuit to convert the analog input signal to digital signal<br>IC2A and IC2C are not used | (1) |
| IC4: | lntegrated Circuit | 7809 | 9 volt regulator | (1) |
| IC5: | lntegrated Circuit | 78L05 | 5 volt regulator | (1) |
| Q1,Q3: | transistor | 2N3904 | to amplify signal and reduce the output impedance | (2) |

TABLE I-continued

PARTS LIST for PAPER DISPENSER

| Element | Name | Model | Description | Quantity |
|---|---|---|---|---|
| Q2: | sensor | photo sensor QSD422QT | to detect the reflected infrared light signal from a user's hand | |
| Q4: | transistor | TIP110 | to drive the motor to move the paper | (1) |
| C1: | capacitor | .082UF/50V | the timing capacitor of the pulse generator IC3 | |
| C5: | capacitor | 22UF/16V | by-pass capacitor | (1) |
| C6,C8: | capacitor (2) | 2.2UF/16V | by-pass capacitor | (2) |
| | | | | (1) |
| C2,C3: | capacitor | 6800PF/50V | the filter capacitor of the high pass filter IC1C (2) | |
| C4: | capacitor | 2200PF/50V | coupling capacitor | (1) |
| C7,C10: | capacitor | .47UF/50V | coupling capacitor | |
| C8: | capacitor | 15UF/16V | the timing capacitor of the Monostable timing circuitr IC2B | (1) |
| QT | to emit infrared light source | | (T) | |
| D2,D3,D4,D5,D6,D7,D8 | diode | 1N4148 | D2,D3,D4,D5: to set required DC offset voltage of the circuit | (9) |
| C9: | capacitor | 1UF/16V | by-pass capacitor | (1) |
| C12: | capacitor | 4700UF/25V | power source capacitor | (1) |
| C13,C14: | capacitor | 100UF/16V | by-pass capacitor | (2) |
| D1: | infrared LED | QED522D6,D7,D8: | to control the direction of the signal | |
| D9,D10: | Diodes: | 1N4001 | D9: to limit the revertive impulse D10: the power Rectifier Diodes (1N4001X4) | (5) |
| W1: | variable resistor | 10K/0.25W | to adjust the system sensitivity and noise immunity | (1) |
| W2: | variable resistor | 100K/0.25W | to adjust the paper throughput | (1) |
| R1,R3,R11,R22,R25: | resistor | 10K/0.125W | basic elements of circuit | (5) |
| R6,R7,R14,R16,R19,R20,R21,R23: | resistor | 100K/0.125W | basic elements of circuit | (8) |
| R5,R17,R18,R24,R26 | resistor | 4.7K/0.125W | basic elements of circuit | (5) |
| R4: | resistor | 510K/0.125W | basic elements of circuit | (1) |
| R2: | resistor | 120/0.25W | basic elements of circuit | (1) |
| R9: | resistor | 1k/0.125W | basic elements of circuit | (1) |
| R8: | resistor | 3K/0.125W | basic elements of circuit | (1) |
| R10: | resistor (1) | 220K/0.125W | basic elements of circuit | |
| R12,R15: | resistor | 1M/0.125W | basic elements of circuit | (2) |
| R13: | resistor (1) | 2K/0.125W | basic elements of circuit | |
| R27: | resistor (1) | 47K/0.125W | basic elements of circuit | |
| MOTOR: | | 12V DC | to move the paper | (1) |
| CN1: | | 120V | the power cord | (1) |
| F1 | FUSE: | 0.5A/125V | to protect the system overload | (1) |
| T1: | transformer | 120V/12V | to get a 12V AC voltage power source | (1) |

What is claimed is:

1. A photonic paper product dispenser for dispensing a portion of a roll of a paper product, comprising:

a. a housing for holding the roll of the paper product therewithin;

b. an infrared light source in the front of said housing, said light source having a variable intensity level;

c. a photodetector in the front of said housing for detecting infrared light from said infrared light source reflected off a user and converting the light received to an electrical signal, said photodetector including a phototransistor;

d. a signal processing circuit for processing said signal from said photodetector said signal processing circuit reducing noise and amplifying the signal form said photodetector;

e. a noise rejection circuit for rejecting signals from light sources other than said infrared light source;

f. a motor;

g. a monostable timing circuit for receiving a signal from the noise rejection circuit and generating a timing signal for controlling the operation of the motor;

h. one or more gears mechanically connected to said motor, said one or more gears rotating upon activation of said motor;

i. a pair of rollers mounted in said housing, one of said rollers being mechanically connected to said gears causing said roller to rotate upon rotation of said gears, the pair of rollers being frictionally engaged with the roll of the paper product thereby causing rotation of the roll of the paper product upon rotation of said roller, rotation of the roll of the paper product advancing a sheet of the paper product out from the housing which can then be removed from the roll; and j. a power supply unit and for providing power to the electrical components in the photonic paper product dispenser, the power supply unit including two different power supplies in order to isolate the infrared light source form the other components therein.

2. A photonic paper product dispenser as claimed in claim 1 wherein both of said pair of rollers are mechanically connected to said gears, both of said pair of rollers rotating upon rotation of said gears.

3. A photonic paper product dispenser as claimed in claim 1 wherein the roll of the paper product is frictionally engaged with said pair of rollers by feeding the roll of the paper product tautly between said pair of rollers.

4. A photonic paper product dispenser as claimed in claim 3 wherein the length of the sheet of the paper product advanced from said housing upon detection of the light by said photodetector is adjustable.

5. A photonic paper product dispenser as claimed in claim 4 wherein the speed in which the sheet of the paper product is advanced from said housing upon detection of the light by said photodetector is adjustable.

6. A photonic paper product dispenser as claimed in claim 5 further comprising an on/off switch for activating and deactivating said photodetector, and a manual button electrically connected to said motor, said manual button when depressed sending a signal to activate said motor which in turn rotates said gears and said rollers, thereby advancing a sheet of the roll of the paper product from the housing which can be removed from the roll.

* * * * *